US005775879A

United States Patent [19]

Durando

[11] Patent Number: 5,775,879

[45] Date of Patent: Jul. 7, 1998

[54] PROCESS AND DEVICE FOR REGULATING A MULTIPHASE PUMPING ASSEMBLY

[75] Inventor: Pierre Durando, Lyons, France

[73] Assignee: Institut Francais du Petrole, Rueil-Malmaison, France

[21] Appl. No.: 604,483

[22] Filed: Feb. 21, 1996

[30] Foreign Application Priority Data

Feb. 21, 1995 [FR] France ..... 95 02083

[51] Int. Cl.[6] ..... F04B 49/06

[52] U.S. Cl. ..... 417/45; 417/44.2; 417/53

[58] Field of Search ..... 417/19, 45, 44.2, 417/53

[56] References Cited

U.S. PATENT DOCUMENTS

| | | | |
|---|---|---|---|
| 3,568,771 | 3/1971 | Vincent et al. . | |
| 4,248,194 | 2/1981 | Drutchas et al. | 123/357 |
| 4,390,321 | 6/1983 | Langlois et al. | 417/53 |
| 4,678,404 | 7/1987 | Lorett et al. . | |
| 5,240,380 | 8/1993 | Mabe . | |
| 5,393,202 | 2/1995 | Levallois | 417/19 |

FOREIGN PATENT DOCUMENTS

| | | |
|---|---|---|
| 2685737 | 7/1993 | France . |
| 2215408 | 9/1989 | United Kingdom . |

OTHER PUBLICATIONS

World Oil, vol. 204, No. 5, May 1987, Houston, pp. 31–33, J.F. Lea & H. W. Winkler "What's New in Artificial Life".

*Primary Examiner*—Ayaz R. Sheikh
*Assistant Examiner*—Xuan M. Thau
*Attorney, Agent, or Firm*—Antonelli, Terry, Stout & Kraus, LLP

[57] ABSTRACT

The invention relates to a process and to a device for regulating a multiphase pumping assembly that includes notably at least one multiphase pump (1), a device (6) for determining a parameter representative of a working instability of multiphase pump (1) and at least one programmed processing assembly (7) allowing to store at least the determined parameter and initial parameter values, and to compute the new value of the speed of said multiphase pump in order to bring the working point of the pump back into its operating range.

12 Claims, 3 Drawing Sheets

V (t/mn)

Nm
P(bars)
II
II
III
I
III
Z1
Z2
t(s)
0
20
40
60
80
100

PROCESS AND DEVICE FOR REGULATING A MULTIPHASE PUMPING ASSEMBLY

FIELD OF THE INVENTION

The present invention relates to a method and to a device for regulating a pumping assembly allowing a multiphase fluid to be transferred from a source to a point of destination.

It notably applies to the field of petroleum production where the fluids are effluents coming from wells and comprising at least one gas phase and at least one liquid phase.

Transferring these effluents from a well or a set of wells to a processing place is achieved by means of a pumping assembly comprising at least one multiphase pump.

The main purpose of this pump is to confer on the fluids admitted at the inlet thereof with a certain admission pressure or suction pressure a sufficient energy to ensure their transfer by compensating the pressure drops they can undergo during transfer downstream and upstream from the pump.

In the present text, the terms upstream and downstream refer to the pump considering the direction of flow of the effluents and the term flow rate generally relates to the volumetric flow rate.

BACKGROUND OF THE INVENTION

During production, these wells can have an unstable behavior, with a cyclic running that is characterized by an alternation of active and inactive production periods. Such a cyclic running leads to variations notably in the production flow rate, that can appear for an activated well or a well whose life is nearing its end.

The behavior variations of the above-cited wells or the closing of a well when a set of wells is connected to the pump can lead to instabilities in the running of the pump, such as a hydraulic disadjustment thereof that can cause its deterioration or even its destruction.

In case multiphase fluids consisting of a liquid phase and a gas phase at least are pumped, one of the problems consists in knowing precisely the liquid flow rate and the gas flow rate upstream from the pump, and the above-mentioned method intended for compressors and based on a measurement of the flow rate upstream from the device cannot be applied simply to fight against the phenomenon of disadjustment of a multiphase pump.

The regulations known from the prior art for multiphase pumps are in most cases "on-off" type regulations that consist in stopping the multiphase pump when an instability is detected. However, although such regulations prove to be effective, they also involve drawbacks. In fact, inopportune stoppings of the pump lead to a decrease in its availability ratio, hence a production loss. Furthermore, such stops thereafter require operations of restarting of the pumping group and possibly of the wells that can be delicate.

The prior art, notably the claimant's French patent application FR-2,685,737, also describes a method and a device allowing to regulate the speed of a pump intended to pump multiphase fluids as a function of one or several parameters.

Patent application FR-2,685,737 teaches to regulate the speed of a multiphase pump so as to adapt the pump flow rate to a variation that can occur upstream and/or downstream from the pump, by combining several parameters.

However, none of these documents teaches how to regulate a multiphase pump in order to avoid instability phenomena or hydraulic disadjustment that can lead to its damaging.

It may be reminded that a pump intended for the production of multiphase fluids is characterized by a family of hydraulic curves. This family of hydraulic curves has to be adapted to the production conditions and to the evolutions in time of the well or of the wells connected to the pumping group, as well as to the "downstream environment conditions". The term "downstream environment conditions" relates for example to the pressure drops occurring in the resistant circuit situated downstream from the pump, including the transfer lines and all the associated equipments that are generally used within the scope of petroleum production.

An operating range defined on the one hand by limits specific to the pumping group, such as, for example, the hydraulic disadjustment limit, and on the other hand by production conditions such as the flow rate expected by the producer and the characteristics of the resistant circuit situated downstream from the pump is determined from this family of hydraulic curves.

The pump works properly within its operating range, i.e. its mechanical and hydraulic behavior is satisfactory and it communicates to the effluent a sufficient compression energy to ensure its transfer from one place to another.

SUMMARY OF THE INVENTION

The present invention thus consists in remedying the above-cited drawbacks notably by regulating the running of a multiphase pumping assembly comprising at least one multiphase pump, by acting upon the speed of the pump in order to bring it back into its operating range.

The invention advantageously applies for managing and for controlling hydraulic instabilities due to an unexpected variation in the flow rate of the production well, that can lead to damage risks for the multiphase pump.

It applies to any field where the pumping devices have similar structures to those stated above, that can cause the appearance of destructive phenomena, for example for devices suited for pumping fluids having facies that are substantially identical to those of multiphase flows.

It can also apply as a regulation method complementing a device for damping the composition variations of a multiphase flow, vacuum ratio variations or GLR (gas liquid ratio) variations.

The present invention relates to a method allowing to regulate a pumping assembly used for communicating energy to a multiphase effluent consisting of at least one gas phase and of at least one liquid phase, the pumping assembly being positioned between a source of effluents and a point of destination, and including at least one multiphase pump having an operating range.

It is characterized in that at least one parameter representative of a phenomenon of working instability of the multiphase pump is determined and one acts upon the rotating speed of said multiphase pump in order to bring the pump back into its operating range until the instabilities disappear.

The instability phenomenon can be a hydraulic disadjustment of the multiphase pump and one takes action until the instabilities due to the hydraulic disadjustment disappear.

The amplitude of the parameter representative of said instability is for example measured and compared to a given value or value range, and the speed is decreased until the measured parameter value is substantially equal to the given value or value range.

The shaft of the multiphase pump being equipped with a measuring means such as a torquemeter, the value of the torque representative of the instability is for example measured.

The pump can be equipped with a vibration detector such as an accelerometer or a displacement pick-up, and the amplitude of the vibrations is measured.

It is also possible to measure the value of the suction pressure Pa of the multiphase pump and/or the value of the pressure gain of the pump.

After correcting the instability and observing at least a return to the production conditions prevailing prior to the appearance of the instability, one acts for example upon the speed of the multiphase pump in order to bring the working point of the pump back on a curve corresponding to an optimum running, which can be defined in relation to a set and stable suction pressure value.

The present invention advantageously applies to the regulation of a pumping assembly associated with the production of an oil well or of a set of oil wells.

The present invention further relates to a regulated multiphase pumping assembly including at least one multiphase pump, at least one means for determining a parameter representative of a working instability of said multiphase pump and at least one programmed processing assembly allowing to store at least the determined parameter and initial parameter values, and to compute the new value of the speed of said multiphase pump in order to bring the multiphase pump back into its operating range until the instabilities disappear.

The device includes for example a device for damping the variation of the vacuum ratio situated before the multiphase pump.

It can also include a circuit for recirculating an amount of fluid towards the pump inlet.

The fluid recirculated towards the pump inlet can come from an auxiliary fluid source or it can be drawn off after the pump by means of an appropriate device.

The invention thus allows, in a simple and reliable way, to prevent the phenomenon of hydraulic working disadjustment of a pump that can notably be due to a variation in the flow rate of the well or of a set of wells, for example a sudden decrease in this flow rate.

This hydraulic disadjustment phenomenon generates instabilities that can cause a damaging of the pump.

BRIEF DESCRIPTION OF THE DRAWINGS

Other features and advantages of the method and of the device according to the invention will be clear from reading the description hereafter of embodiments given by way of non limitative examples, with reference to the accompanying drawings in which.

DESCRIPTION OF THE PREFERRED EMBODIMENTS

In order to better define the present invention, the description given hereafter by way of non limitative examples relates to the regulation of a multiphase pump connected to a well producing a multiphase effluent, for example a petroleum effluent, and ensuring its transfer to a processing or destination point.

Figure 1:
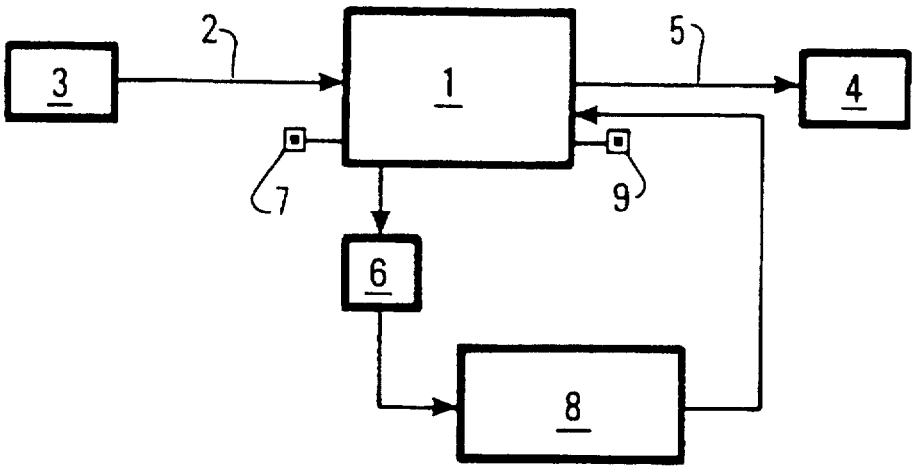
FIG. 1 diagrammatically shows the principle used for regulating a multiphase pumping assembly, FIGS. 2A and 2B respectively show the possible displacement of the working point of the multiphase pump according to the method and the parameter variations indicating the disadjustment phenomenon.

The device described in FIG. 1 includes a multiphase pumping assembly consisting for example of a multiphase pump 1 connected by a line 2 to a source of effluents 3 such as a production wellhead and to a point of destination, for example a processing place 4, by a line 5.

Pump 1 is equipped with a means 6 capable of determining at least one parameter representative of a hydraulic working disadjustment of pump 1. The working instability of pump 1, also referred to as hydraulic disadjustment phenomenon, is characterized for example by a mechanical signature that can be determined from a mechanical parameter such as the torque or the vibrations measured for example on the multiphase pumping group or assembly and/or by a hydraulic signature corresponding to a variation of the pressure value measured for example at the inlet of the multiphase pump or of the pressure gain P of the pump corresponding to the pressure difference between the discharge pressure and the suction pressure of the pump.

The means 6 for determining a parameter can thus advantageously be a device for measuring the torque on the shaft of multiphase pump 1, such as a torquemeter, or a vibration detector such as an accelerometer or a displacement pickup on the pump.

According to another embodiment, the device is provided with a pressure detector 7 that can be, for example, a detector for measuring the admission pressure Pa, or a differential detector allowing to know the pressure gain P of the pump. It can also be used for measuring the instability and it allows to know permanently the pressure value at the pump inlet.

If the pump is equipped with an electric or hydraulic motorization, device 6 can be placed on the motorization and deliver respectively the value of the intensity of current or the pressure of the hydraulic fluid, that can reveal the pump disadjustment phenomenon.

Any other parameter indicating the disadjustment phenomenon and its associated measuring device can be envisaged to characterize and to determine the instabilities without departing from the scope of the invention.

Measuring means 6 and pressure detector 7 are connected to a computer 8 that records and processes the measured data. It therefore knowns permanently the data associated with the measured parameter, such as the amplitude and the frequency. It can also comprise previously stored data, such as initial production data, the characteristics of the multiphase pumps and threshold values, limiting values and given data ranges.

Computer 8 itself is connected to multiphase pump 1 and in particular to the motor of the pump or to a device for regulating the rotating speed of the motor. It can thus act upon the speed of the pump motor and adapt it as a function of the measured parameter or parameters in order to eliminate the instability phenomena observed, for example by bringing the multiphase pump back into an allowed range as described hereafter. Each time an instability, for example a hydraulic instability, is detected, it can thus be eliminated by acting upon the rotating speed of the pump.

The motor of the pump is advantageously provided with a velocity pickup 9 connected to computer 8, that delivers thereto the value of the rotating speed of the pump.

This computer 8 can be a programmed control device or a microcomputer equipped with an acquisition card of a well-known type and programmed to control the stages of the method described hereafter.

The method described hereafter by way of non limitative examples advantageously applies during the production of a well and notably when an unexpected and random flow rate variation occurs, the amplitude of this variation being high enough to generate a phenomenon of disadjustment of the multiphase pump.

Figure 2A:
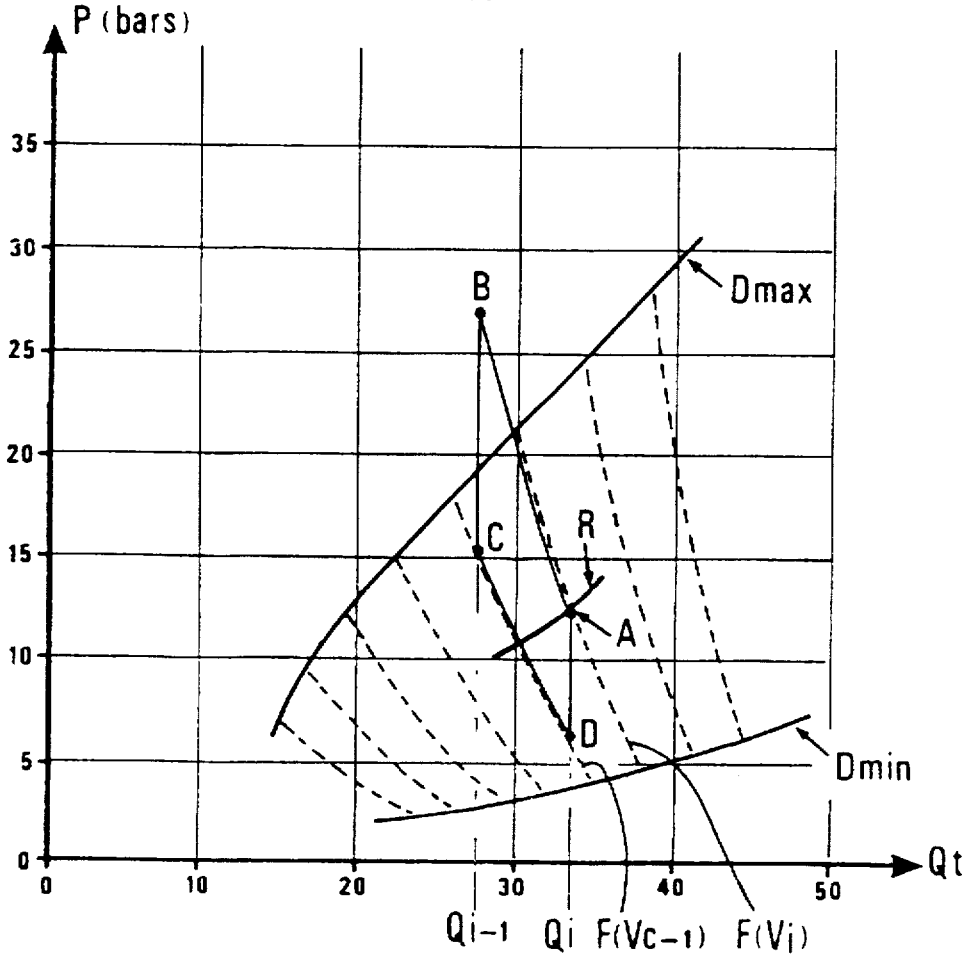

Multiphase pump 1 is adapted to its upstream environment (well flow rate and conditions set by the producer) and to its downstream environment (resistant production circuit), and an operating range described for example in FIG. 2A is associated therewith.

The operating range of a multiphase pump 1 is determined for a given suction pressure value Pa and for a given volumetric ratio GLRa or for a value of the vacuum ratio at the pump inlet. The volumetric ratio GLRa is defined as the gas-liquid ratio of the multiphase effluent and the vacuum ratio as the ratio of the volume of gas to the total volume (liquid-gas).

This range comprises a family of characteristic curves $F(V_i)$ giving the pressure gain as a function of the total flow rate Q of the well, corresponding to the sum of the flow rates of the liquid phase and of the gas phase forming the whole of the multiphase effluent. These curves $F(V_i)$ are drawn up for different pump speed values and represented in FIG. 2A by the family of curves $F(V_1)$, $F(V_2)$,. . . ($F(V_i)$,. . . It is limited by two curves Dmax and Dmin, and in particular by the curve Dmax or curve of hydraulic disadjustment of the pump. This disadjustment curve corresponds to an upper boundary or limit that must not be exceeded, the operating behavior of the pump becoming unstable above this limit.

In FIG. 2A, the curve of the resistant circuit situated downstream from the pump is partly schematized by segment R. It represents the pressure drops in relation to the total production flow rate of the well.

A working point of the pump situated at the intersection of a characteristic curve $F(V_i)$ (corresponding to a rotating speed $V_i$of the pump) and of the Curve of the resistant circuit R is for example determined from the above-cited families of curves $F(V_i)$ and from the curve corresponding to the resistant circuit R.

For example, in FIG. 2A, point A corresponds to the working point of a multiphase pump, determined for example from the rotating speed $V_i$ of the pump set by the given production conditions. For a given rotating speed, point A can move along curve $F(V_i)$ during a flow rate variation with a constant GLR without going beyond the disadjustment curve Dmax.

This working point can correspond to the initial production conditions.

Figure 2B:
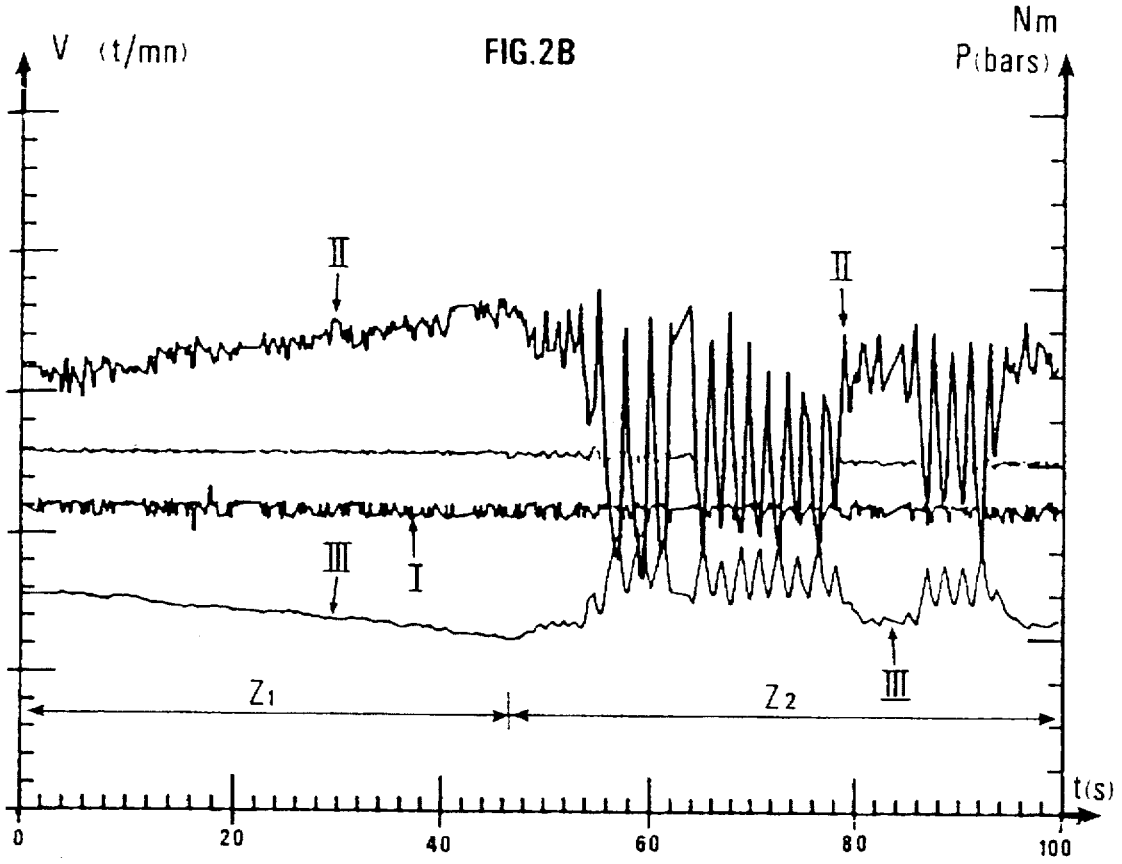

When the flow rate Q of the well decreases suddenly and, at the same time, the rotating speed remains substantially stable, instabilities in the running of the pump, shown for example in FIG. 2B by zone $Z_2$ or disadjustment zone, are likely to appear. The zone $Z_1$, schematized in the figure corresponds to correct working conditions of the pump.

In this FIG. 2B, curves (II), (III) and (I) represent respectively the value of the torque measured for example on the rotation shaft of the pump and expressed in Nm, the admission pressure Pa measured for example at the inlet of the multiphase pump and expressed in bars, and its rotating speed in revolutions per minute as well as their variations with time.

In disadjustment zone $Z_2$, the torque determined at the level of the pump shaft (curve II, FIG. 2B) oscillates in a random and uncontrolled way corresponding to a disadjustment of the pump that can lead to its damaging. Since the pump is in an unstable working condition, working point A (FIG. 2A) passes to a new working point represented in FIG. 2B by the point B situated above the maximum curve Dmax and therefore outside the operating range of the pump.

Computer 8 receives permanently the measurement coming from torquemeter 6, the value of the admission pressure Pa from detector 7 and the measurement of the rotating speed of the pump from detector 9. It is for example programmed to control these measured values and to act upon the rotating speed, for example when these values indicate a working instability of the pump as described hereafter.

When computer 8 detects an abnormal variation of the value of the torque corresponding, in FIG. 2A, to the passage from point A to point B, it sends a control signal to the motor or to the device regulating the speed of the motor in order to decrease the rotating speed of the pump until the disadjustment phenomenon disappears, i.e. until the working instabilities of the pump disappear.

To that effect, the measured torque value can be compared with a reference value set by the initial production conditions of the well. For example, when the difference between these two values is greater than or equal to ±/ 10% for example of a mean initial value in time, the computer sets off the command for decreasing the rotating speed. The signal is sent until the disadjustment phenomenon and therefore the instabilities disappear.

This speed decrease causes the working point to pass from point B to a point C situated below the disadjustment curve Dmax, which brings it back into the operating range of the pump and to an allowed value, the stage allowing the pump to be brought back to a normal working condition or zone $Z_1$ being thus achieved.

Computer 8 can control in different ways that the passage of the working point from a non-allowed condition to an allowed condition is complete. It can check that point C is situated below the disadjustment curve Dmax for example by comparing the new value of the torque measured after this speed decrease to a given value that is, for example, recorded in the computer.

The new value of the rotating speed of the pump, for example $V_{i-1}$ measured after the disappearance of the instabilities, is given by detector 9 in connection with computer 8. After the instabilities have disappeared, point C is on an operating curve $F(V_{i-1})$ situated in the operating range corresponding to the new speed value of the pump.

Curve $F(V_{i-1})$ corresponds in this example to a rotating speed $V_{i-1}$ that is less than the initial rotating speed $V_i$ of the pump, and to a total flow rate value $Q_{i-1}$ of the well that is less than the initial flow rate value $Q_i$ of the well. When the production conditions tend to get back to production conditions substantially identical to the conditions prevailing before the appearance of the disadjustment phenomenon, the working point of the pump moves on curve $F(V_{i-1})$ from point C for example to point D. However, such working conditions do not correspond to an optimum running of the multiphase pump or of the pumping assembly ensuring an optimum production of the well or of the wells when production gets back to stable production conditions.

In fact, the sudden decrease of the value of the production flow rate corresponds to an unusual event within the scope of production. After this decrease, the well will start producing again with a flow rate value corresponding to the nominal flow rate value, for example $Q_i$. It is therefore desirable, in order to optimize the production, to readapt the speed of the pump to its initial speed value $V_i$ which consists in FIG. 2A in bringing point D back to the initial working point A.

Pressure detector 7 permanently measures the value of the admission pressure Pa of the pump. Computer 8 therefore continuously knows the value of this pressure Pa and it can easily control the proper return to production of the production well. By controlling the value of the pressure Pa measured at the pump inlet in relation to a set value representative of the initial production conditions of the well and previously recorded in computer 8, it identifies the return to a normal production and sends a control signal towards the motor or the device regulating the speed of the motor so as to increase the rotating speed of the pump and to bring point D back to the initial working point A.

Computer 8 can reiterate the operations of torque measurement and of speed regulation in order to bring the working point back into the allowed operating range as described above, which corresponds to the shift cycles of points A, B, C, as long as the operating trouble lasts in the production of the well.

Determining the parameter representative of the instability can also be performed by measuring the value of the suction or admission pressure at the pump inlet and/or the pressure gain of the pump. Computer 8 thereafter proceeds identically in order to act upon the rotating speed and to bring the pump back into an allowed operating range.

All the above-cited parameters (admission pressure, pressure gain, . . .) can be used to implement the stages of the method described above.

In a complementary way, computer 8 can determine the value of the frequency of the phenomenon from the measurement of the representative parameter. By means of the value of the frequency and of the amplitude of the measured parameter that indicates the disadjustment, the computer can possibly "sign" the phenomenon, i.e. know its nature.

The method described above advantageously applies to the regulation of a pump connected to a source of effluents consisting of several wells.

In this case the oil wells are connected by lines to the pump inlet in a way that is known to the man skilled in the art. The lines can be provided with valves or regulating devices notably allowing a well to be isolated.

The flow rate variation at the pump inlet can be due, for example, to the closing or to a behavior variation of at least one of the wells.

The method described in connection with FIGS. 2A and 2B advantageously applies also for a pumping assembly described in connection with FIG. 3 in which a device for damping the variation of the vacuum ratio or of the GLR is situated upstream from the pump.

Figure 3:
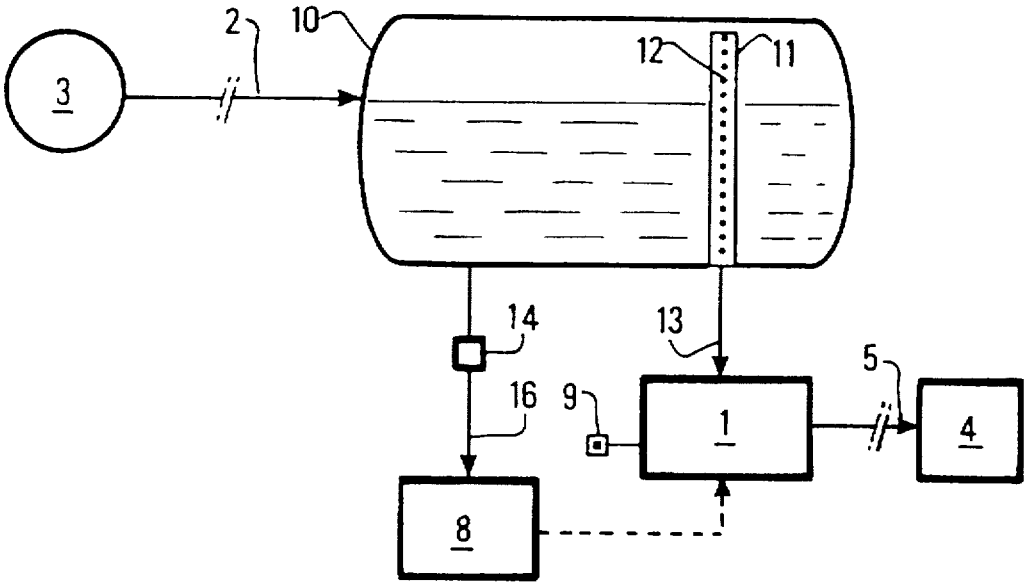
FIG. 3 shows a pumping assembly including a multiphase pump associated with an assembly for damping the vacuum ratio or the GLR variation.

In FIG. 3, a regulating drum 10 is positioned on line 2 before the inlet of the multiphase pump. This drum, described in detail in the claimant's patent FR-2,642,539, includes a sample tube 11 provided with ports 12 distributed over at least part of the length of tube 11. The tube runs right through the drum for example. The multiphase effluents flow into drum 10 through line 2 and they flow out through tube 13 connecting drum 10 to pump 1 with a controlled GLR.

The regulating drum is equipped with a pressure detector 14 that determines the pressure prevailing in the drum and corresponding substantially to the value of the admission pressure Pa of the multiphase pump.

As in FIGS. 2A and 2B, the value of the torque and its variation with time are measured, and as described above, computer 8 decreases the rotating speed of the pump until the working instabilities disappear.

It is also possible, instead of measuring the torque, to measure the value of the suction pressure Pa and to implement the stages described above.

Figure 4:
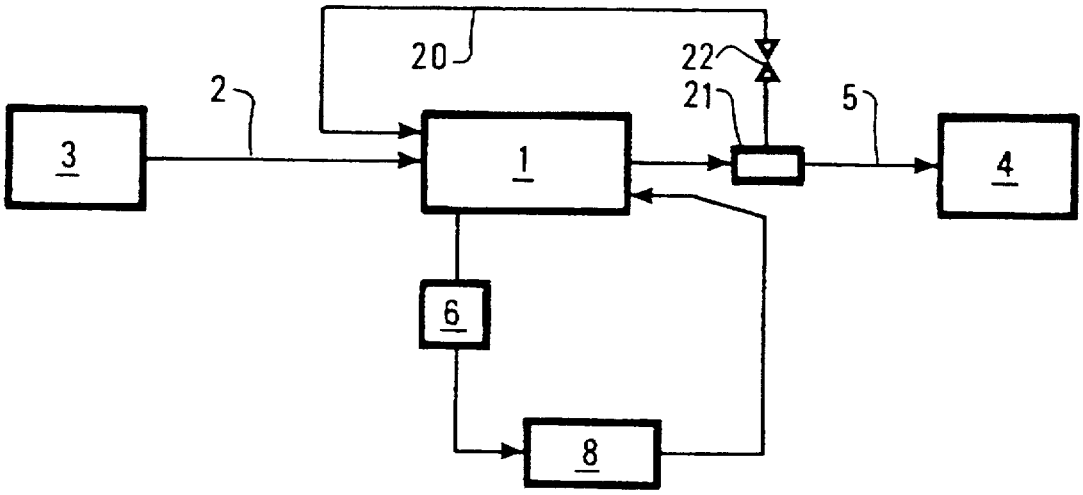
FIG. 4 shows the device of FIG. 1 associated with means for recirculating a fluid.

FIG. 4 describes an embodiment variant associating a multiphase recirculation circuit 20 situated between the outlet and the inlet of the pump with the feedback loop described above.

A device 21 for drawing off the multiphase effluent is positioned for example downstream from pump 1 on line 5. The amount of fluid thus drawn off is run through circuit 20 towards the inlet of multiphase pump 1 so as to have an additional flow of fluid and to compensate a possible decrease in the production flow rate. A valve 22 situated after device 21 and on circuit 20 is connected to computer 8. When computer 8 detects an instability as described above, it sets off the opening of valve 22.

The additional fluid recirculated to the pump inlet can also come, in another embodiment, from an auxiliary source of fluid connected by a line to the pump inlet and to computer 8.

I claim:

1. A method of regulating a pumping assembly used for communicating energy to a multiphase effluent comprising at least one gas phase and at least one liquid phase, said pumping assembly being positioned between a source of effluents and a point of destination and including at least one multiphase pump having a predetermined operating range, said method comprising the steps of:

determining one parameter representative of a working hydraulic instability of the multiphase pumps, measuring the amplitude of the parameter representative of the instability, and regulating the value of the rotating speed of said multiphase pump so as to bring the pump back into its operating range until the working hydraulic instability represented by the measured value of said parameter disappears.

2. A method as claimed in claim 1, wherein the amplitude of the parameter representative of said instability is compared to a given value or value range and the speed is decreased until the measured value of the parameter is substantially equal to the given value or to the given range.

3. A method as claimed in claim 1, wherein the multiphase pump having a shaft equipped with a measuring means and the value of the torque representative of the instability is measured.

4. A method as claimed in claim 1, wherein the pump is equipped with a vibration detector and the amplitude of the vibrations is measured.

5. A method as claimed in claim 1, wherein the value of the suction pressure of the multiphase pump and/or the value of the pressure gain of the pump are measured.

6. A method as claimed in claim 1, wherein, after correcting the instability and observing at least a return to the production conditions prevailing prior to the appearance of the instability, regulating the speed of said multiphase pump so as to bring the working point of the pump back on a curve corresponding to an optimum running.

7. A method as claimed in claim 1, wherein the pumping assembly is connected to an oil well or to a set of oil wells.

8. Regulated multiphase pumping assembly comprising at least one multiphase pump having a predetermined operating range, at least one means for determining a parameter representative of a working hydraulic instability of said multiphase pump and at least one programmed processing assembly allowing to store at least the determined parameter representative of said working hydraulic instability and initial parameter values, and to compute, by taking account of said parameter representative of the instability and/or of the initial parameters, the new value of the speed of said multiphase pump so as to bring the multiphase pump back into its operating range until the working hydraulic instability represented by the measured value of said parameter disappears.

9. A device as claimed in claim 8, comprising a device for damping the variation of the vacuum ratio situated before multiphase pump.

10. A device as claimed in claim 8, comprising a circuit for recirculating an amount of fluid to the pump inlet.

11. A method as claimed in claim 3, wherein said measuring means comprises a torquemeter.

12. A method as claimed in claim 4, wherein said vibration detector comprises an accelerometer or a displacement pickup.

* * * * *